US008154508B2

(12) United States Patent
Wang et al.

(10) Patent No.: US 8,154,508 B2
(45) Date of Patent: Apr. 10, 2012

(54) REPEATED-SCAN DRIVING METHOD FOR FIELD SEQUENTIAL COLOR LIQUID CRYSTAL DISPLAY

(75) Inventors: Shyh-Yueh Wang, Taichung (TW); Chia-Hui Chen, Taichung County (TW); Chiu-Yuan Huang, Taichung (TW); Chun-Tsai Chien, Taichung (TW)

(73) Assignee: Powertip Technology Corp., Taichung (TW)

( * ) Notice: Subject to any disclaimer, the term of this patent is extended or adjusted under 35 U.S.C. 154(b) by 489 days.

(21) Appl. No.: 12/412,374

(22) Filed: Mar. 27, 2009

(65) Prior Publication Data

US 2010/0245229 A1 Sep. 30, 2010

(51) Int. Cl.
*G09G 3/36* (2006.01)

(52) U.S. Cl. ..... 345/102; 345/87

(58) Field of Classification Search ..... 345/82–102, 345/204

See application file for complete search history.

(56) References Cited

U.S. PATENT DOCUMENTS

| | | | | |
|---|---|---|---|---|
| 5,977,934 | A * | 11/1999 | Wada et al. | 345/3.1 |
| 2002/0163490 | A1 * | 11/2002 | Nose | 345/89 |
| 2003/0006953 | A1 * | 1/2003 | Yang et al. | 345/90 |
| 2006/0158454 | A1 * | 7/2006 | Heynderickx et al. | 345/589 |
| 2008/0192158 | A1 * | 8/2008 | Yoshihara et al. | 349/33 |

* cited by examiner

*Primary Examiner* — Nitin Patel
(74) *Attorney, Agent, or Firm* — Muncy, Geissler, Olds & Lowe, PLLC

(57) ABSTRACT

The present invention discloses a REPEATED-SCAN driving method, which applies to a field sequential color liquid crystal display, wherein each sequential-color cycle of the multiplex-scan signal has at least two stages of scans to increase the luminous fluxes of all colors of backlights and bring closer the total amounts of fluxes, whereby is achieved higher color saturation and better flux uniformity between the rows. Further, the method of the present invention controls the backlights to form dark stages between the intervals respectively of two different colors of the backlights and controls the dark stage to coincide with a color-mixing interval, which is caused by response delay of liquid crystal, to prevent from color distortion caused by color mixing. Therefore, the present invention can generate the pure colors and the designed derived colors accurately.

3 Claims, 8 Drawing Sheets

REPEATED-SCAN DRIVING METHOD FOR FIELD SEQUENTIAL COLOR LIQUID CRYSTAL DISPLAY

FIELD OF THE INVENTION

The present invention relates to a REPEATED-SCAN driving method for an FSC LCD, particularly to an FSC LCD driving method, which can increase luminous flux and color saturation.

BACKGROUND OF THE INVENTION

In FSC LCD (Field Sequential Color Liquid Crystal Display), multi-color backlights are sequentially switched and pass through liquid crystal optical gates. FSC LCD opens and closes the liquid crystal optical gates to sequentially generate pure-color fields, and then the visual persistence of human eyes mixes the pure colors to present various colors. Refer to FIG. 1. The control signal 1 is used to open and close the liquid crystal optical gates. However, the light transmission curve 2 cannot instantly reflect the control signal 1 because the delayed response of liquid crystal molecules. Thus, there are response delays 3 appearing in the light transmission curve 2.

Refer to FIG. 2 a timing diagram of a conventional FSC LCD technology. In the timing diagram, the duty ratio is 1/4; C0, C1, and C3 (C2 is neglected) are the signals 4 scanning the common (row) electrodes of an LCD panel in a time-sharing multiplex mode; Sn is the signal 4 scanning the segment (column) electrodes of the LCD panel. The abovementioned signals 4 C0, C1, C3 and Sn cooperate with the multi-color backlights 5—a red backlight 6 (R), a green backlight 7 (G), and a blue backlight 8 (B), which sequentially and cyclically switch—to work.

Refer to FIG. 3 a diagram schematically showing the luminous fluxes of colored lights of a conventional FSC LCD driven by the signals shown in FIG. 2. In FIG. 3, the integral areas (the fluxes) of the red backlight 6 (R), a green backlight 7 (G), and a blue backlight 8 (B) are small and inconsistent, and the latter color may mix with the former color. Thus, the row luminous fluxes 9 have problems of dimness and color distortion, as shown in FIG. 4.

SUMMARY OF THE INVENTION

The primary objective of the present invention is to provide a REPEATED-SCAN driving method for an FSC LCD to increase the luminous fluxes, bring closer the total amounts of the fluxes, and decrease flux difference between rows, whereby is achieved higher color saturation and better flux uniformity between the rows.

Another objective is to increase the luminous fluxes with the purity of colors maintained and without color mixing occurring, whereby is improved the problem of color distortion.

To achieve the abovementioned objectives, the present invention proposes a REPEATED-SCAN driving method for an FSC LCD and a device for realizing the same method. The method of the present invention comprises steps:

providing at least two colors of backlights, which sequentially switch; and providing at least one multiplex-scan signal with the cycle of the color sequence corresponding to the timing of switching backlight colors, wherein each cycle of the multiplex-scan signal has at least two stages of scans.

In the present invention, a dark stage is arranged between the intervals respectively of two different colors of backlights and coincides with the color-mixing interval, which is caused by the response delay of liquid crystal, to prevent from mixing of different colors of backlights.

In the present invention, at least two stages of scans are arranged within every sequential-color cycle to increase the luminous fluxes, bring closer the total amounts thereof, and decrease flux variation between the rows, whereby colors may have higher saturation and uniformity. Further, the present invention provides a dark stage to prevent from mixing of different colors of backlights. Therefore, the present invention not only can prevent from color distortion of pure colors but also can present the correct derived colors.

DETAILED DESCRIPTION OF THE PREFERRED EMBODIMENTS

Below, the embodiments are described in detail in cooperation with the drawings to demonstrate the objectives, characteristics and efficacies of the present invention.

Figure 1:
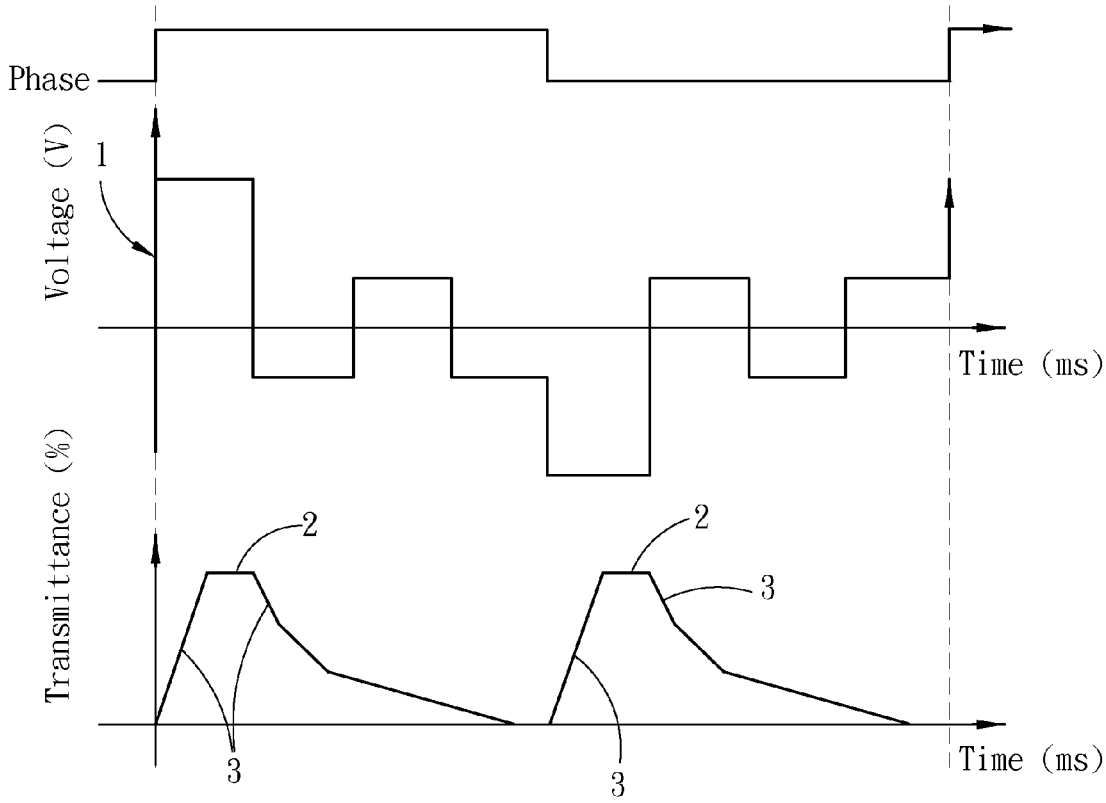
Fig. 1 PRIOR ART
FIG. 1 is a diagram schematically showing the imperfect optical response of a conventional FSC LCD.
Figure 2:
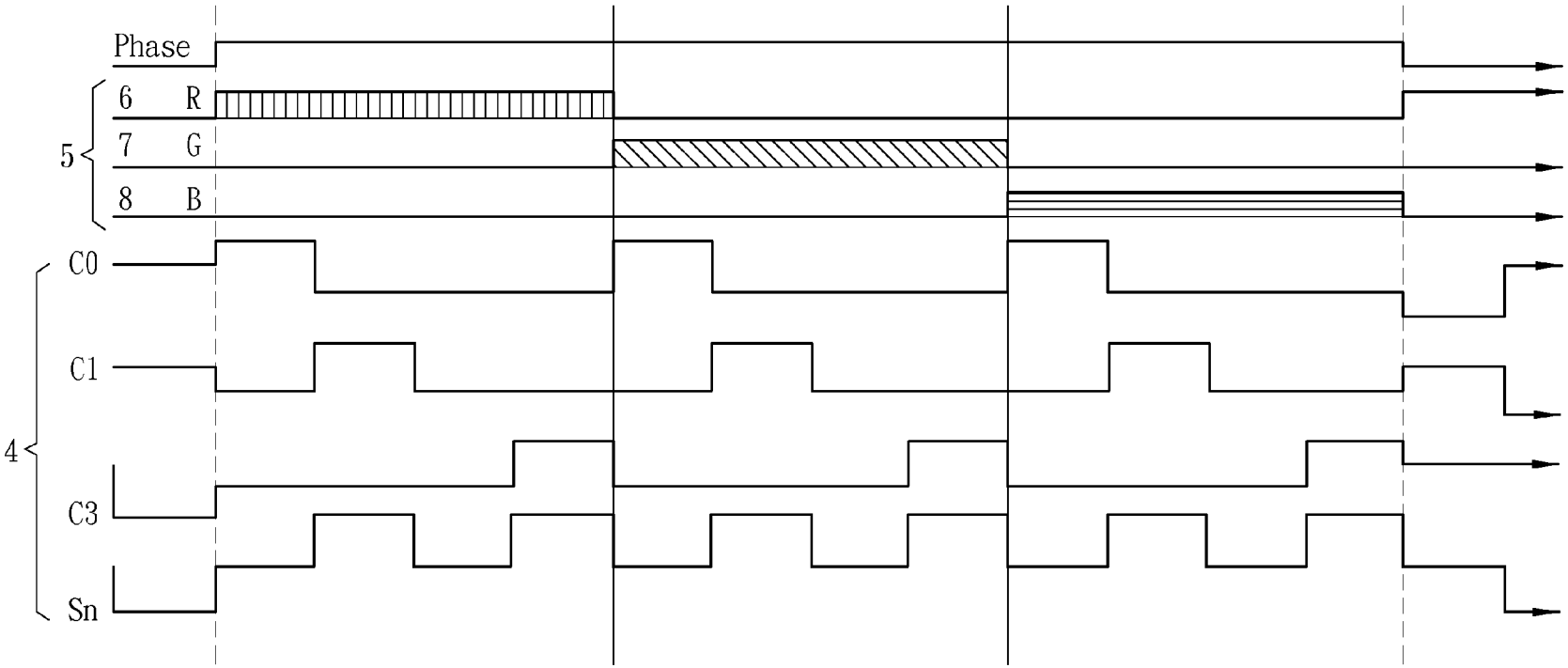
Fig. 2 PRIOR ART
FIG. 2 is a timing diagram of a conventional multiplex-scan technology for an FSC LCD.
Figure 3:
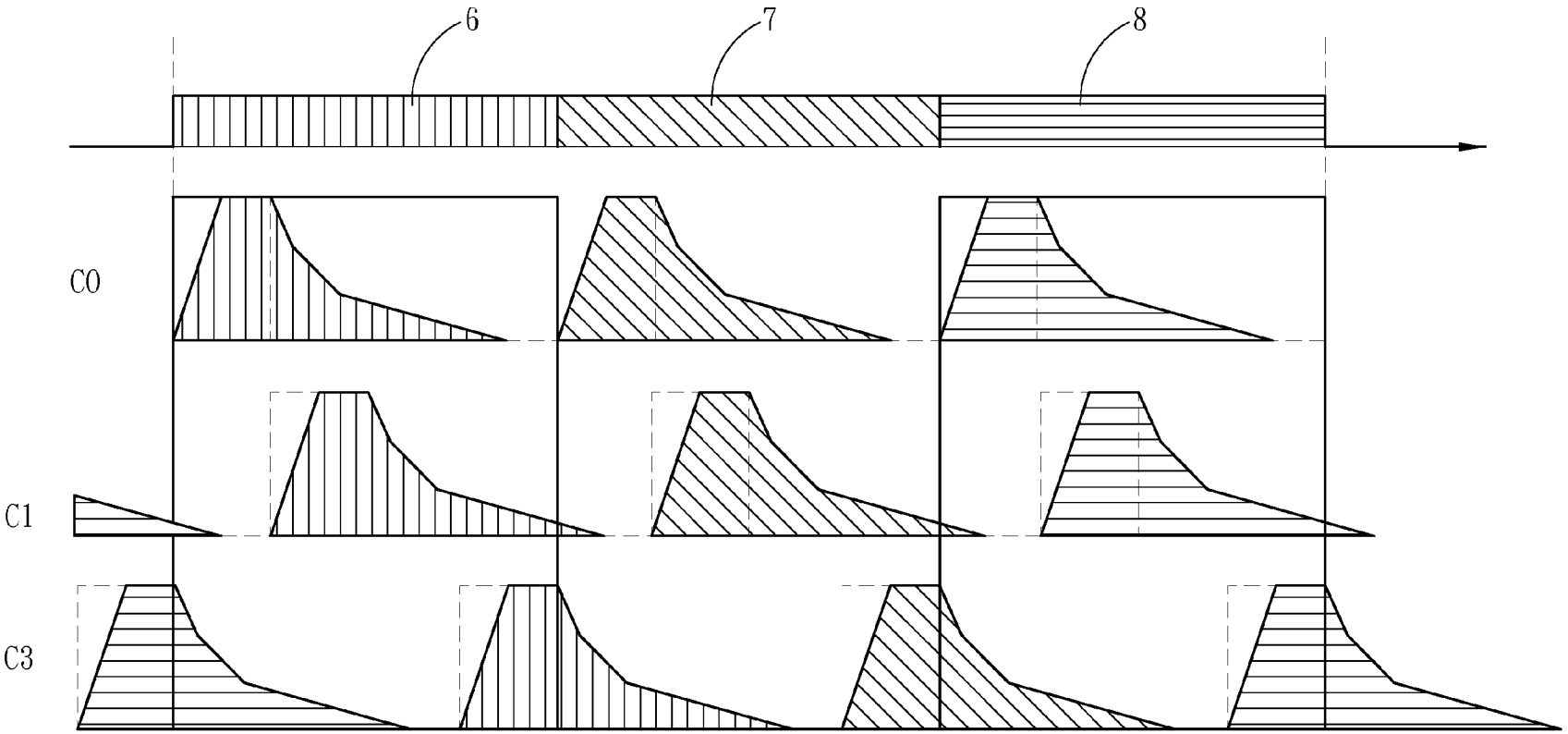
Fig. 3 PRIOR ART
FIG. 3 is a diagram schematically showing the luminous fluxes of various colors of backlights of a conventional FSC LCD.
Figure 4:
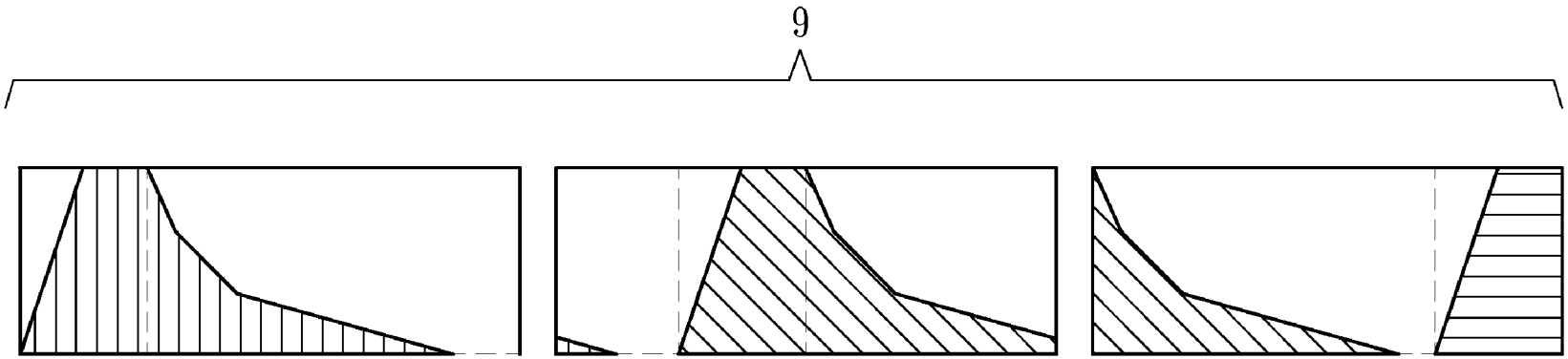
Fig. 4 PRIOR ART
FIG. 4 is a diagram schematically showing color mixing and flux variation between the rows in a conventional FSC LCD.
Figure 5:
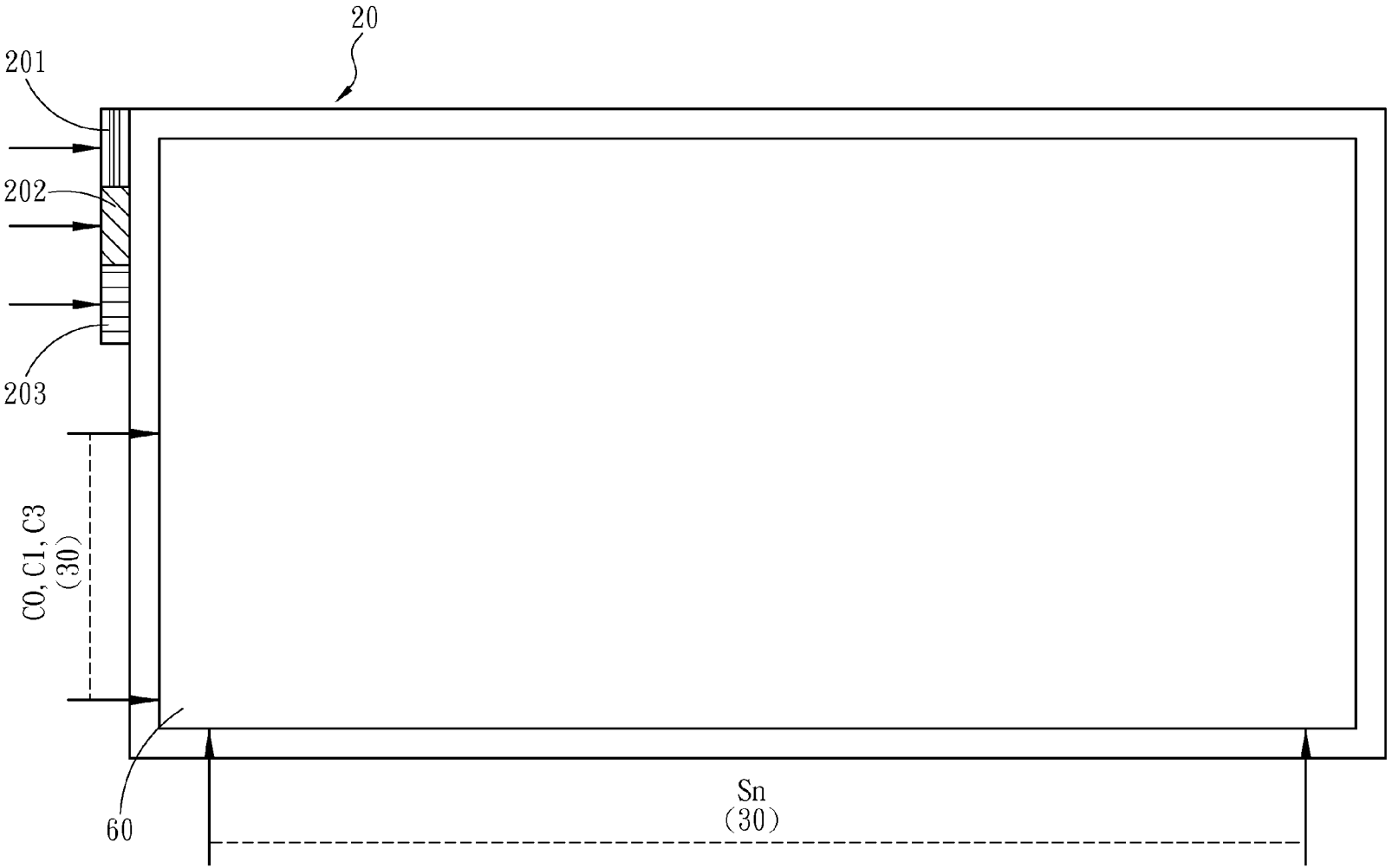
FIG. 5 is a diagram schematically showing an FSC LCD according to the present invention.
Figure 6:
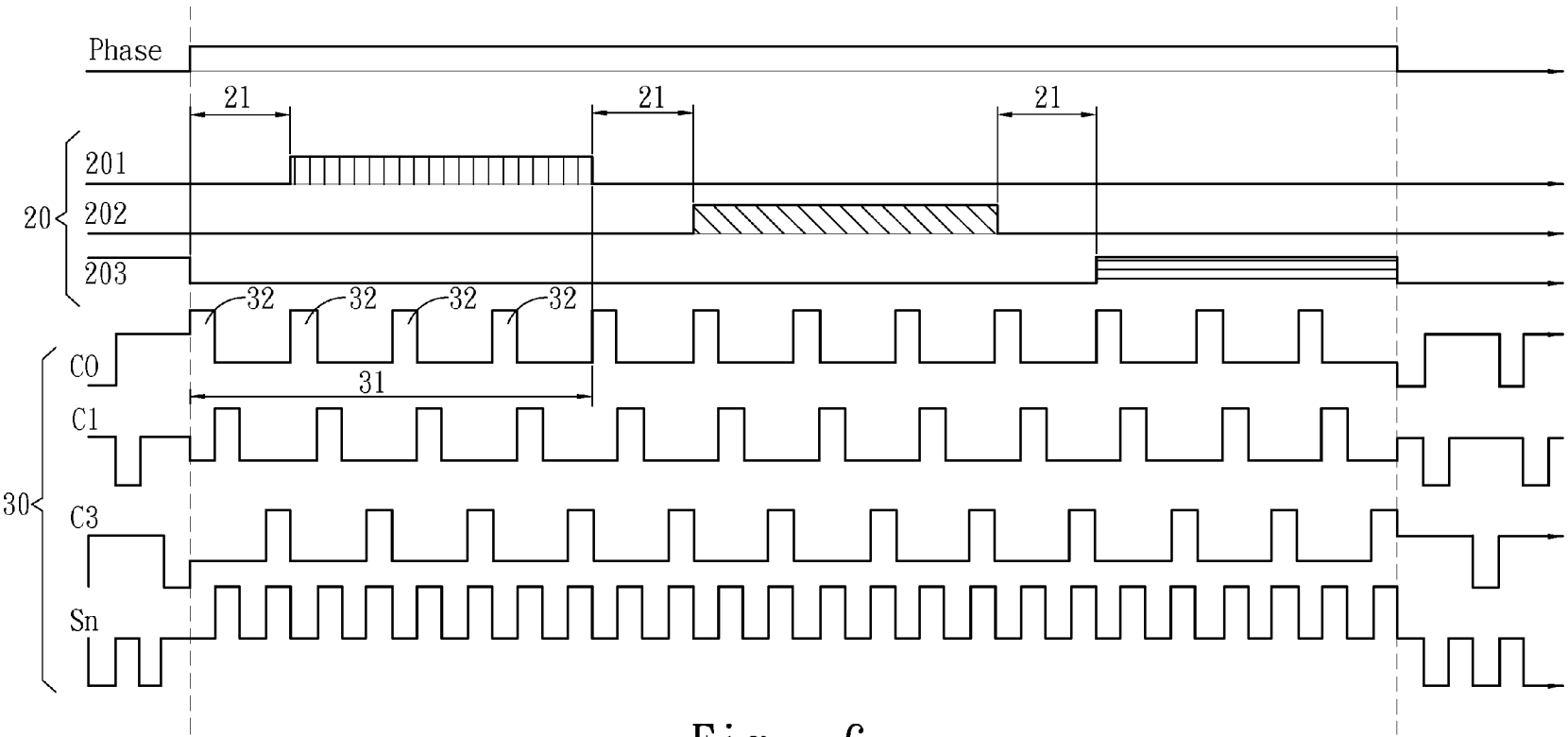
FIG. 6 is a timing diagram for controlling an FSC LCD according to a method of the present invention.

Refer to FIG. 5 and FIG. 6. The present invention proposes a REPEATED-SCAN driving method for an FSC LCD 60 (Field Sequential Color Liquid Crystal Display). The method of the present invention provides at least two colors of backlights 20, which sequentially switch. In the method, a dark stage 21 is arranged between the intervals respectively of two different colors of backlights 20. The backlights 20 can include a red backlight 201, a green backlight 202 and a blue backlight 203, which sequentially switch. Besides, the dark stage 21 can be arranged in the very beginning of the backlights 20.

The present invention provides at least one multiplex-scan signal 30. The sequential-color cycles 31 of the scan signals 30 are corresponding to the timing of switching the colors of backlights 20. Each sequential-color cycle 31 has at least two stages of scans 32. In the drawings, the duty ratio of the multiplex-scan signal 30 is exemplified by 1/4. In the drawings, C0, C1, and C3 (C2 is neglected) are the signals scanning the common (row) electrodes of the LCD panel in a time-sharing mode, and Sn is the signal scanning the segment (column) electrodes of the LCD panel. In the drawings, the sequential-color cycle 31 having four stages of scans 32 is used as the exemplification.

Figure 7:
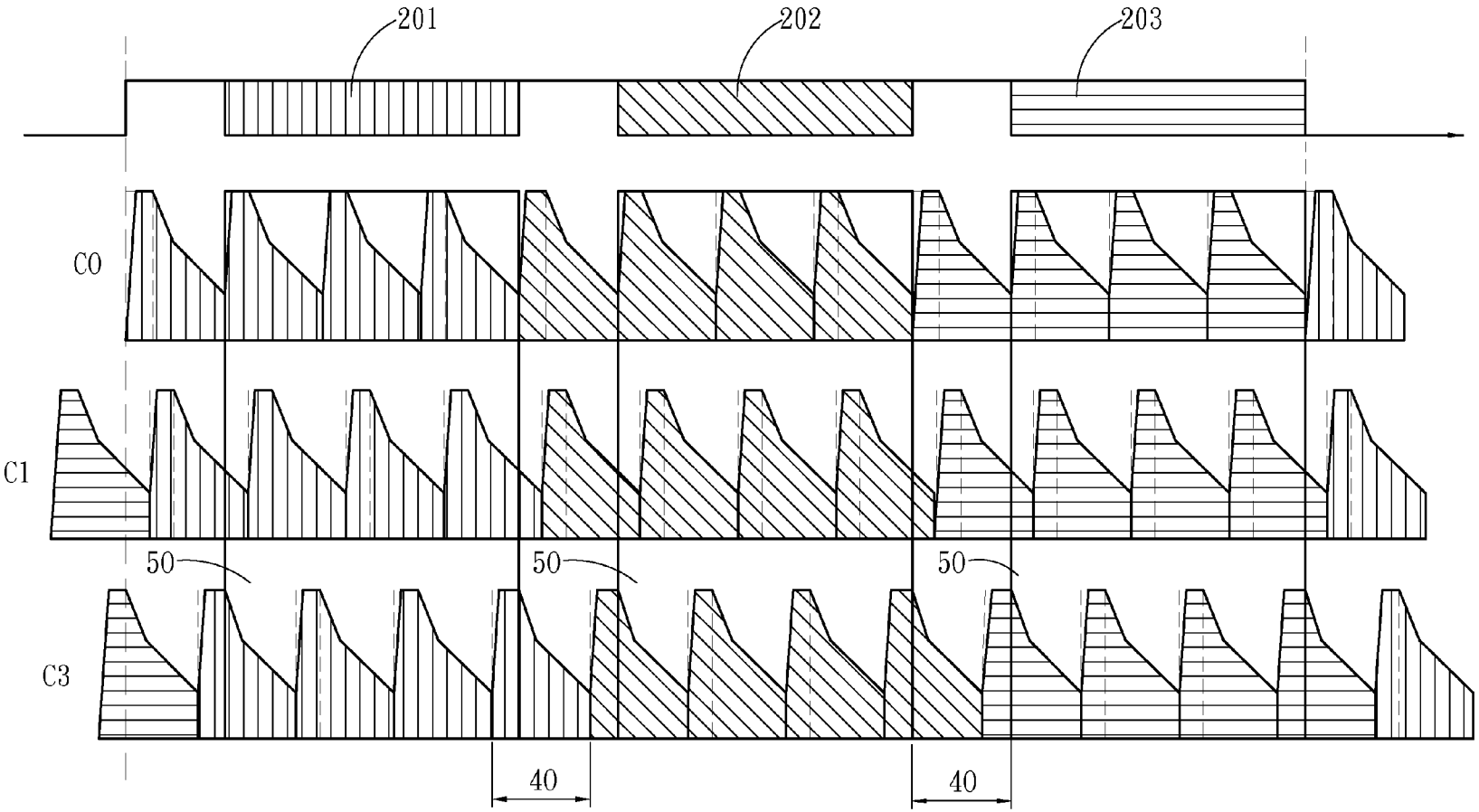
FIG. 7 is a diagram schematically showing the luminous fluxes of various colors of backlights of an FSC LCD according to the present invention.

Refer to FIG. 7. The multiplex-scan signal 30 in FIG. 6 drives the FSC LCD 60 to output the luminous fluxes of the red backlight 201, the green backlight 202, and the blue backlight 203 shown in FIG. 7. From FIG. 7, it is known that at least two stages of scans 32 are arranged within every sequential-color cycle 31 to increase the luminous fluxes, bring closer the total amounts of fluxes, and decrease flux variation between the rows. Thus, the present invention can increase color saturation and promote flux uniformity between the rows. Further, the method of the present invention can control the dark stage 21 to coincide with the color-mixing interval 40, which is caused by the response delay of liquid crystal. Thus, none color mixing occurs in the effective luminous interval 50, and color distortion is prevented. Therefore, the present invention can generate pure colors and derived colors accurately.

Figure 8:
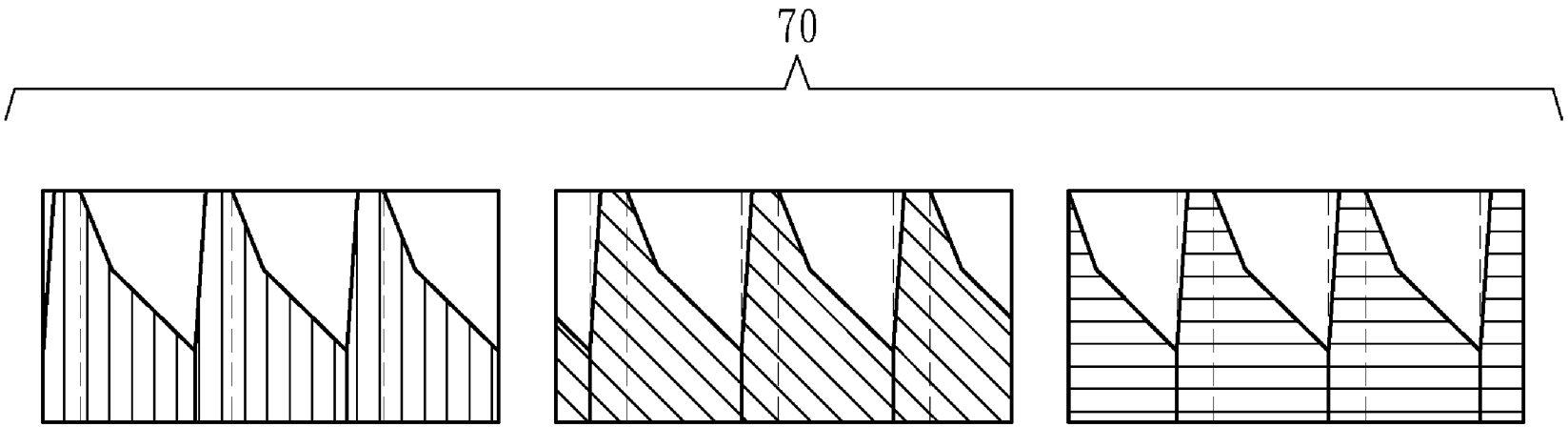
FIG. 8 is a diagram schematically showing color mixing and flux variation between the rows in an FSC LCD according to the present invention.

In conclusion, the method of the present invention provides at least two stages of scans 32 for each sequential-color cycle 31 to increase row fluxes 70, bring closer the total amounts of the fluxes, and decrease flux variation between the rows, as shown in FIG. 8. Further, the method of the present invention controls the backlights 20 to form the dark stages 21 to prevent from the unwanted color mixing. Therefore, the present invention can generate the pure colors and the designed derived colors accurately.

What is claimed is:

1. A method for driving a field sequential color liquid crystal display, the method comprising the step of:

switching sequentially at least two colors of backlights;

having at least two stages of scans in each of the sequential-color cycles of a scan signal, wherein sequential-color cycles of said scan signal correspond to timing of switching colors of said backlights;

wherein a dark stage is arranged between intervals respectively of two different colors of said backlights, and dark stage is controlled to coincide with a color-mixing interval, which is caused by response delay of liquid crystal.

2. The method for driving a field sequential color liquid crystal display according to claim 1, wherein said dark stage is arranged in the very beginning of said back light.

3. The method for driving a field sequential color liquid crystal display according to claim 1, wherein said backlights include a red backlight, a green backlight and a blue backlight, which sequentially switch.

* * * * *